US005894616A

United States Patent [19]

Graham et al.

[11] Patent Number: 5,894,616

[45] Date of Patent: Apr. 20, 1999

[54] FOLD UP SAFETY PAD FOR LOW CLEARANCE BEDS

[76] Inventors: Charles L. Graham, Rte. 7, Box 1000, McAllen, Tex. 78504; Fred C. Plumer, P.O. Box 1447, Elizabeth, Colo. 80107; Michael W. Megown, 205 N. Two St., Mathasville, Mo. 63357

[21] Appl. No.: 08/845,891

[22] Filed: Apr. 28, 1997

[51] Int. Cl.[6] ..... A47C 21/08

[52] U.S. Cl. ..... 5/424; 5/663; 5/420

[58] Field of Search ..... 5/420, 424, 427, 5/430, 663

[56] References Cited

U.S. PATENT DOCUMENTS

| | | | |
|---|---|---|---|
| 29,038 | 7/1860 | Keene et al. . | |
| 4,214,328 | 7/1980 | Custer, Jr. et al. | 5/494 |
| 4,606,087 | 8/1986 | Alivizatos | 5/424 |
| 4,788,726 | 12/1988 | Rafalko | 5/93 R |
| 4,985,952 | 1/1991 | Edelsor | 5/420 X |
| 5,044,025 | 9/1991 | Hunsinger et al. | 5/424 |
| 5,052,065 | 10/1991 | West | 5/424 |
| 5,070,557 | 12/1991 | Vincent et al. | 5/424 |
| 5,191,663 | 3/1993 | Holder et al. | 5/424 |
| 5,359,739 | 11/1994 | Rains et al. | 5/81.1 |
| 5,455,973 | 10/1995 | Brumfield et al. | 5/424 |
| 5,491,851 | 2/1996 | Alonso | 5/420 X |
| 5,542,135 | 8/1996 | Ozrovitz et al. | 5/424 |
| 5,592,705 | 1/1997 | West | 5/424 |
| 5,720,057 | 2/1998 | Duncan | 5/420 |

*Primary Examiner*—Michael F. Trettel

*Attorney, Agent, or Firm*—Jacobson, Price, Holman & Stern, PLLC

[57] ABSTRACT

A foldable pad assembly is provided for use along at least one side of a low height bed or bed frame. The pad assembly includes a pair of elongated edge-to-edge aligned pad sections with the adjacent edges of the pad sections loosely joined together for relative angular displacement between a stored generally coplanar position along the side of the bed and a deployed generally parallel position on the floor adjacent the side of the bed to which the pad assembly is attached. An integral flexible panel has one marginal edge secured relative to the free edge of the inner panel section, and the opposite marginal edge is secured to and extends along the associated one side of the low height bed. The pad assembly further includes straps for encircling the pad sections when in the folded stored position in order to retain the pad sections in the folded position. In the stored position along the bed side, the flexible panel supports the pad sections in a raised position off the floor.

21 Claims, 6 Drawing Sheets

FOLD UP SAFETY PAD FOR LOW CLEARANCE BEDS

BACKGROUND OF THE INVENTION

1. Field of the Invention

This invention relates to a safety or protective pad assembly for use in conjunction with a bed frame, especially low height bed frames. More specifically, the present invention relates to a pad assembly typically used for older or infirm patients, such as in hospitals, nursing homes, assisted living communities or the like to protect persons who may accidentally fall out of bed onto the adjacent floor.

2. Description of Related Art

Numerous prior U.S. patents disclose various forms of cushioning and restraint devices associated with beds and the like for protecting the person in the bed, which include some of the general aspects of the present invention. For example, West U.S. Pat. No. 5,052,065 discloses a deployable air bag which in one embodiment is attached to the side of a bed. The bag inflates when an occupant of the bed is removed or falls out accidentally and serves as a cushion between the occupant and the floor when the bag is inflated. Keene U.S. Pat. No. 29,038 discloses an extension for a bed frame that slides out along one side of the bed and retracts back under the bed. Vincent et al. U.S. Pat. No. 5,070,577 and Custer, Jr. et al. U.S. Pat. No. 4,214,328 disclose restraining systems for occupants of a bed.

Holder et al. U.S. Pat. No. 5,191,663, Hunsinger et al. U.S. Pat. No. 5,044,025, Rains et al. U.S. Pat. No. 5,359,739 and Ozrovitz et al. U.S. Pat. No. 5,542,135 also disclose passive restraining systems utilizing pads for the bed rails. Further, Rafalko U.S. Pat. No. 4,788,726 and Alivizatos U.S. Pat. No. 4,606,087 disclose pads for a small child that incorporate padding beneath and to the side of the child.

However, none of the above prior art discloses a protective pad structure especially adapted for low clearance beds which can be mounted on either side of the bed frame and can be readily folded between a raised out of the way position extending along one side of the low clearance bed and a deployed horizontal position lying generally flat upon the floor outwardly of the bed one side in order to provide protection should the bed occupant fall out of the bed.

In this regard, federal and state laws pertaining to "no restraint" nursing homes and hospitals bar restraining patients in their beds or allowing patients to lie on the floor. Further, federal and state house keeping rules require that pads previously placed upon the floor as protection for patients who might fall out of bed not be allowed to remain on the floor when a patient is out of the bed. These laws and rules must be carefully followed if the facility is to avoid poor ratings (graded on an accumulative point basis) by state inspectors, because low ratings can result in probationary periods or, in extreme cases, revocation of licenses.

Accordingly, a need exists for a pad assembly which can be positioned or deployed along one or both sides of a low clearance bed for persons or patients who may have a tendency to fall out of bed. The pad assembly can thus serve not only to cushion the patient's fall to the floor from the bed but also to prevent the patient from lying on the floor after he or she falls out of bed.

SUMMARY OF THE INVENTION

The present invention provides a pad assembly having at least one elongated pad section which can be folded between a stored raised position extending along one side of an associated low clearance bed and a deployed horizontal position lying generally flat upon the floor outwardly of the bed one side. The pad assembly is attached to the bed frame such that the pad assembly may be maintained in the raised position out of contact with the floor when the patient is not in the bed and may be deployed to a position lying upon the floor along side the associated bed when the patient is in the bed.

The pad assembly of the present invention is designed for use on either side of a low clearance bed so that it can be installed on the open side if the bed is placed against a wall. Alternatively, the pad assembly of this invention can be used on both sides of a low clearance bed if the sides of the bed are both spaced away from opposing walls. The pad assembly is further designed to be semipermanently attached to the bed in such a manner that it may be folded into a compact position while attached to the associated bed along one side in an elevated position above the floor when the patient is not in his or her bed. As such, the pad assembly of the present invention does not require a separate storage area, but rather is folded into an out of the way configuration along the one side of the associated bed.

In addition, the pad assembly is preferably made of a pair of foldable pad sections having substantially the same rectangular size which are interconnected along one of their longer edges by an interconnecting web or the like. When deployed on the floor along side the bed, the pad sections lie in an edge-to-edge relation and have a first set of corresponding major area side surfaces resting upon the floor and a second set of major area side surfaces facing upwardly for cushioned support of a patient thereon. The interconnecting web between the pad sections is preferably designed so that the pad sections may be easily folded into a compact side-by-side relationship.

When a patient is not in the bed, the pad assembly is folded and stored along the side of the bed to which it is mounted with the pad sections in a generally edge upstanding relation. The first set of major area side surfaces of the pad sections then become the inner opposing surfaces of the folded pad assembly. In this manner, these side surfaces which were previously in contact with the floor are preferably shielded and not exposed. As such, when in a stored condition the pad assembly surfaces previously in contact with the floor cannot be accidentally contacted by the patient.

The outer cover and surfaces of the pad assembly of the present invention can be constructed of any suitable material, preferably one which is nonporous, bacteria and fungus resistant and meets all applicable health and fire codes. Vinyl or other tough plastic materials are most preferred because of their durability and ease of cleaning. The internal padding of the pad assembly can also be made of any suitable padding material but should also be constructed of bacteria and fungus resistant material which meets applicable fire codes.

Accordingly, it is an object of this invention to provide a floor pad assembly which can be mounted along one side of a low height bed frame and can be deployed so that a major portion of the assembly lies flat on the floor adjacent that bed side.

A further object of the present invention is to provide a floor pad assembly in accordance with the preceding object in which a pair of similar assemblies can be mounted on both sides of an associated bed frame for deployment to protect a person in the bed from injuring his or her self when falling from the bed on either side.

A still further object of the present invention is to provide a floor pad assembly which may be stored alongside the corresponding bed when not in use in a position raised from the floor.

Yet a further object of the present invention is to provide a pad assembly in accordance with the preceding object in which the pad assembly is stored in such a manner that the surfaces of the pad assembly previously engaged with the floor are shielded against contact by a person or patient in the bed.

Another object of this invention is to provide a pad assembly in accordance with the two preceding objects which will define a slight lateral extension of the associated bed side and provide resistance to a patient falling out of the bed, even when the pad assembly is in a folded raised position along side the bed.

Another object of this invention is to provide a pad assembly in accordance with the preceding objects which includes support structure for mounting the pad assembly to the bed so that the assembly may be adjusted in accordance with the height of the bed frame above the floor.

Another object of this invention is to provide a pad assembly which will conform to health and fire regulations.

A final object of this invention to be specifically enumerated herein is to provide a floor pad assembly for low clearance beds which will conform to conventional forms of manufacture, be of simple construction and easy to install and use so as to provide a safety device that will be economically feasible, long lasting and relatively trouble free in installation and operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
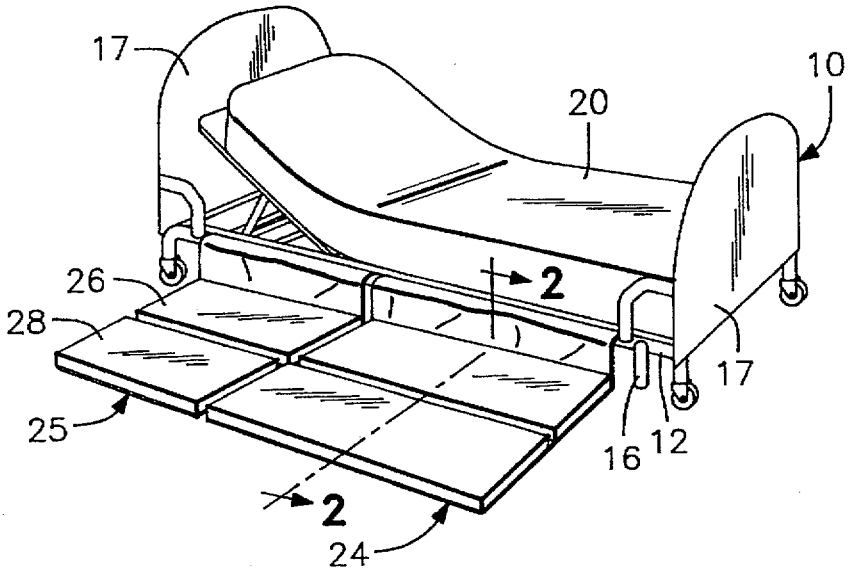
FIG. 1 is a perspective view of a pair of deployed pad assemblies in accordance with the present invention shown in operative association with a first type of nursing home low clearance bed.

In describing the preferred embodiments of the present invention, specific terminology will be resorted to for the sake of clarity. However, the invention is not intended to be limited to the specific embodiments illustrated in the drawings and described herein. It should be understood that each specific term used herein includes all technical equivalents which operate in a similar manner to accomplish a similar purpose.

Figure 2:
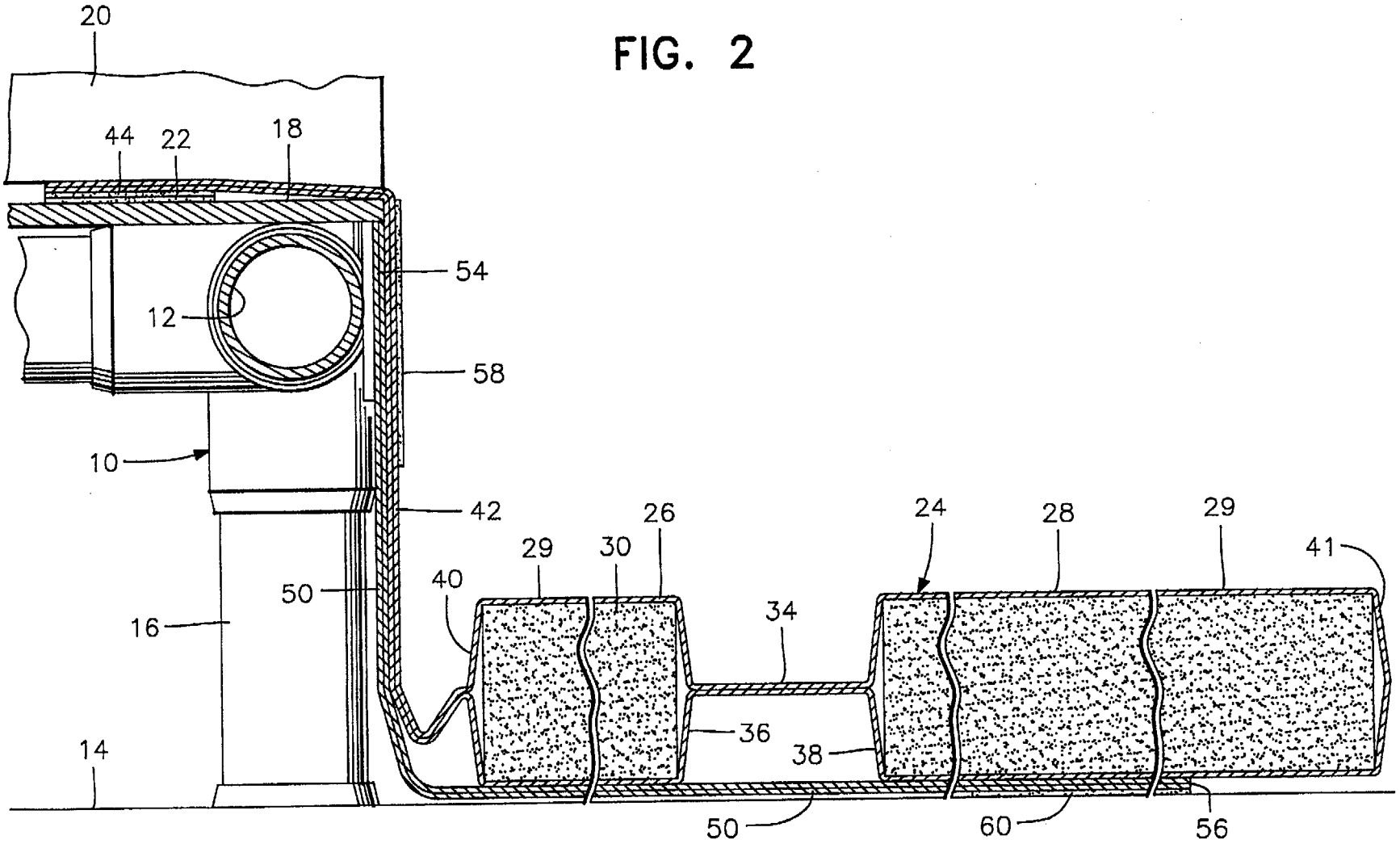
FIG. 2 is an enlarged fragmentary transverse vertical sectional view taken substantially upon the plane designated by the section line 2—2 of FIG. 1.
Figure 3:
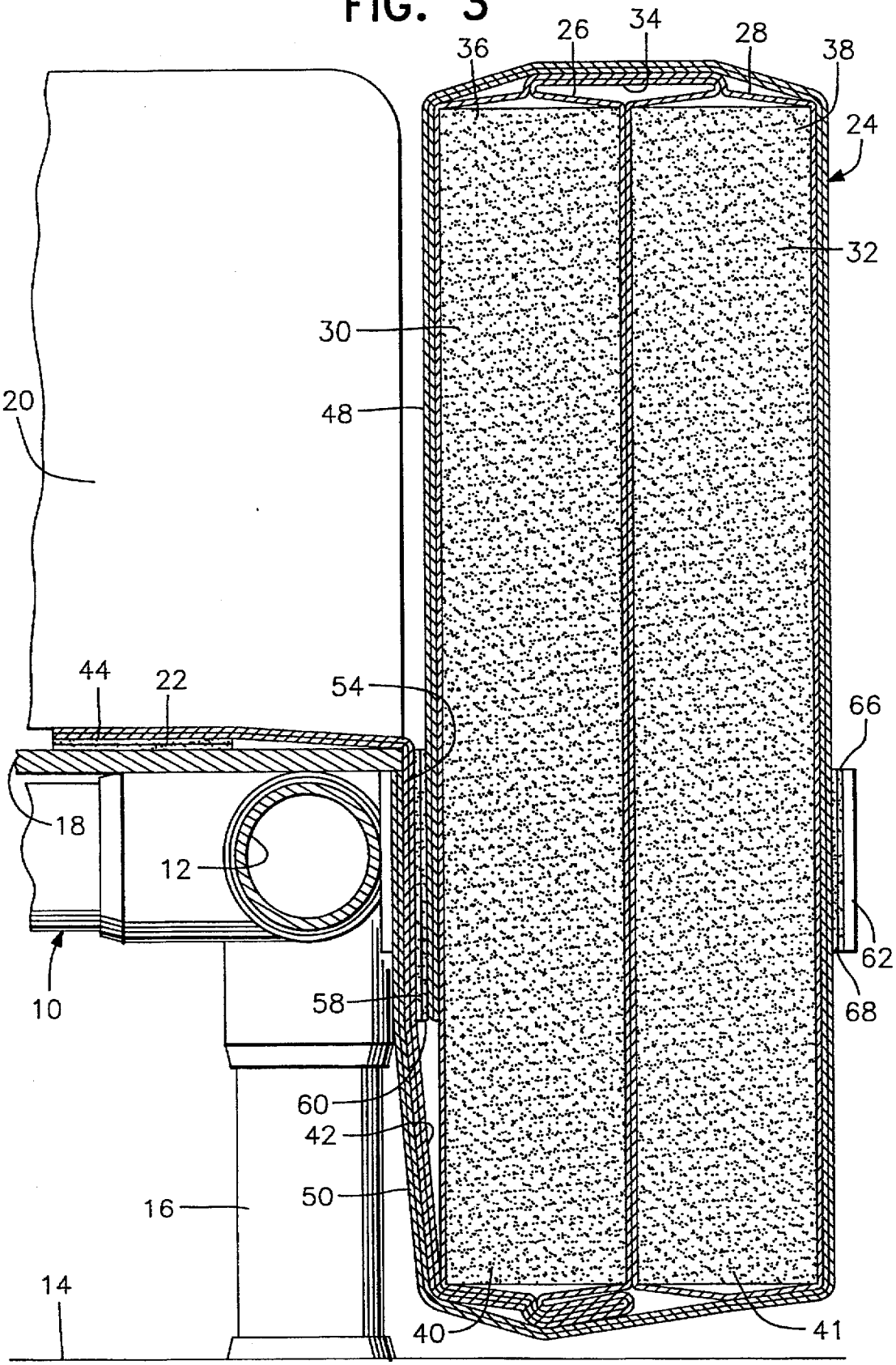
FIG. 3 is an enlarged fragmentary vertical sectional view similar to FIG. 2 but illustrating the pad assembly in a raised and folded position elevated slightly above the floor.

Referring now more specifically to FIGS. 1–3 of the drawings, the numeral 10 generally designates a typical low clearance bed for nursing home use and the like. Although the bed 10 is preferably constructed of PVC tubing, it is to be understood that the bed could be constructed of metal, wood or other suitable materials. Further, it is contemplated that the pad assembly of the present invention can be operatively associated with any standard bed or bed frame typically used in nursing homes, hospitals, assisted living communities and the like.

As may be seen from FIGS. 1 and 3, the bed 10 includes a side rail or tube 12 which is supported above the floor 14, typically between 4 and 10 inches, by short legs 16. The bed 10 includes headboard and footboard 17 and a panel or board 18 extending lengthwise of the bed and supported on the side rails 12. Mattress 20 is then supported on the panel 18, all in a well known bed construction. A hook pile fastener strip 22, such as used in standard VELCRO® hook and loop pile fasteners, is secured to the upper surface of the panel 18 as by adhesive or the like, and extends longitudinally along the side of the panel 18. Preferably, the hook fastener strip 22 is continuous along the side of panel 18; however, the strip 22 may be discrete fastener sections appropriately spaced along the side of the panel 18, or otherwise mounted on the bed frame or bed structure.

As shown in FIG. 1, there are two pad assemblies associated with the side of bed 10, a foot end pad assembly generally designated by the numeral 24 and a head end pad assembly generally designated by the numeral 25. Each pad assembly 24 and 25 is operatively associated with the side of the bed 10, and the pad assemblies 24 and 25 are identically constructed, except that the foot end pad assembly 24 is preferably longer than the head end pad assembly 25. In a preferred embodiment, pad assembly 24 is approximately 40 inches long and pad assembly 25 is approximately 20 inches long, for a total pad length of about 60 inches. Of course, pad assemblies 24 and 25 can be of any desired length, including equal lengths, or different lengths as described above. Further, a single pad assembly of appropriate length can be used, if desired.

Each pad assembly 24 and 25 preferably includes a pair of rectangular pad sections, inner section 26 and outer section 28. Each pad section 26 and 28 also preferably has approximately the same width for reasons to be described hereinafter. However, in its broad sense, the present invention is not limited to a pad assembly which includes a pair of rectangular pad sections of approximately the same size. The pad assembly may include any number of pad sections greater than two, preferably in pairs, or may include only a single tubular pad section, which can be rolled or folded into a stored condition.

The outer covering 29 of the pad sections 26 and 28 are preferably constructed of a vinyl or other tough plastic material which is nonporous, bacteria and fungus resistant, and which meets all applicable fire and health codes. Preferred materials are those which have a high durability and cleanability. The pad sections 26 and 28 contain resilient pads 30 and 32, which also are preferably constructed of bacteria, fungus and fire resistant material.

In FIGS. 1 and 2 the pad sections 26 and 28 are shown in their deployed configuration, arranged in edge-to-edge aligned relation, whereas in FIG. 3 the sections 26 and 28 are shown in their raised folded position. The pad assembly sections 26 and 28 preferably are joined by a double thickness portion of the vinyl covering material 29 which forms a longitudinal web connection 34 between the rectangular sections 26 and 28. The web connection or double thickness portion 34 forms a loose hinge between the sections 26 and 28 thus enabling easy pivoting thereof between the slightly spaced and aligned deployed position illustrated in FIGS. 1 and 2 and the side-by-side raised position illustrated in FIG. 3.

The covering 29 for pad assembly sections 26 and 28 includes a first adjacent pair of end margins 36 and 38 which are joined by the double thickness portion 34 and a second pair of end margins 40 and 41 which are remote from each other when the pad assembly 24 is deployed as illustrated in FIGS. 1 and 2.

The vinyl material comprising the covering 29 on each side of the pad assembly sections 26 and 28 are preferably one piece, and the inner side extends beyond the end margin 40 thereof. The covering extensions are secured together, as by stitching and/or gluing or the like, to form a double thickness flexible sheet or panel 42. When the pad assembly is installed on the bed as shown in FIGS. 1–3, panel 42 extends upwardly from the end margin 40, between the pad section 26 and the adjacent side of the bed 10, and over the outer margin of the panel 18. The outer edge of panel 42 preferably includes a loop pile fastener strip 44 secured to its downwardly facing side which releasably engages with the hook pile fastener strip 22 on panel 18 in order to removably secure and support the pad assemblies 24 and 25 from the bed panel 18, see FIGS. 2 and 3. Of course, if the hook pile fastener strip 22 is separately spaced panel sections, the loop pile fastener strip 44 is similarly configured on the outer edge of panel 42 so that strip 44 properly mates with strip 22 in the appropriate longitudinal position along panel 18 and the associated side of bed 10.

Figure 6:
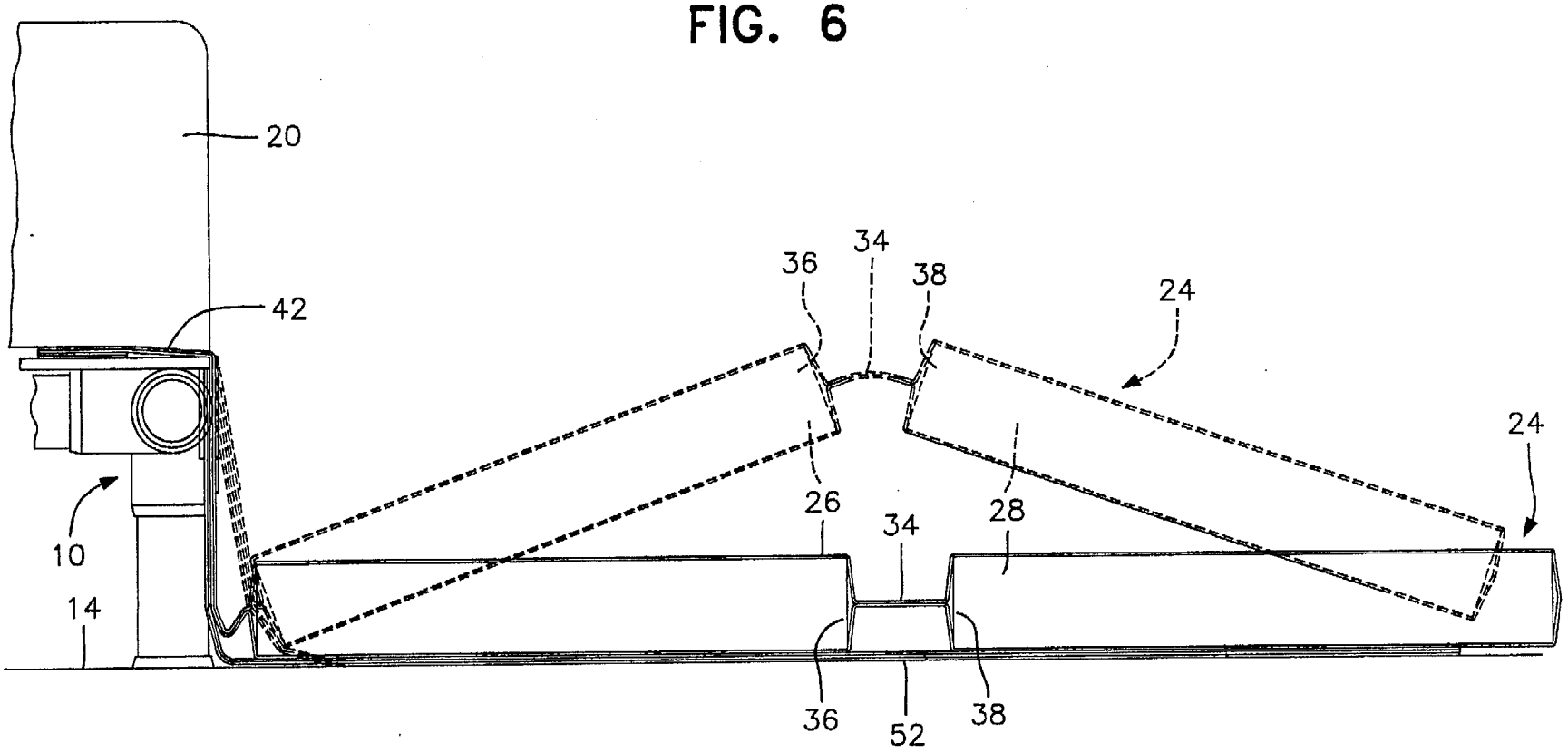
FIG. 6 is a reduced scale schematic view of the structure shown in FIG. 2 and further illustrating a partially folded position of the pad assembly in phantom lines.

With attention now invited more specifically to FIG. 6, it may be seen that the pad sections 26 and 28 are illustrated in solid lines fully deployed and extending outwardly from one longitudinal side of the low clearance bed 10. The pad assembly 24, as well as the pad assembly 25, is positioned in the fully deployed position whenever a patient is on the bed 10. In this position, the pad assembly sections 26 and 28 will cushion the impact of a patient rolling from the mattress 20 toward the floor 14. The width of these sections is selected to ensure that the patient is cushioned under virtually all falls. Widths generally in the range of about 10 to about 24 inches are considered suitable for the present invention, and preferably about 12 to about 16 inches. The pad sections 26 and 28 also are preferably on the order of about two inches thick. In this thickness, connecting web 34 is about 2 to 3 inches wide to accommodate the folding of the sections 26 and 28 into their folded side-to-side relation.

However, when the patient is not on the bed 10, the adjacent end margins 36 and 38 of pad assembly 24 and 25 are raised from the fully deployed position illustrated in solid lines in FIGS. 6, such as by raising upwardly on the web connection 34. By raising end margins 36 and 38, the pad assembly sections 26 and 28 are swung, from the substantially horizontal coplanar deployed position, past the phantom line position illustrated in FIG. 6, toward the fully raised position illustrated in FIG. 3. As the pad sections 26 and 28 are swung from the bold line and phantom line positions illustrated in FIG. 6 to the position illustrated in FIG. 3, the double thickness panel 42 raises the pad sections 26 and 28 to a position slightly elevated above the floor 14, as shown in FIG. 3.

Figure 5:
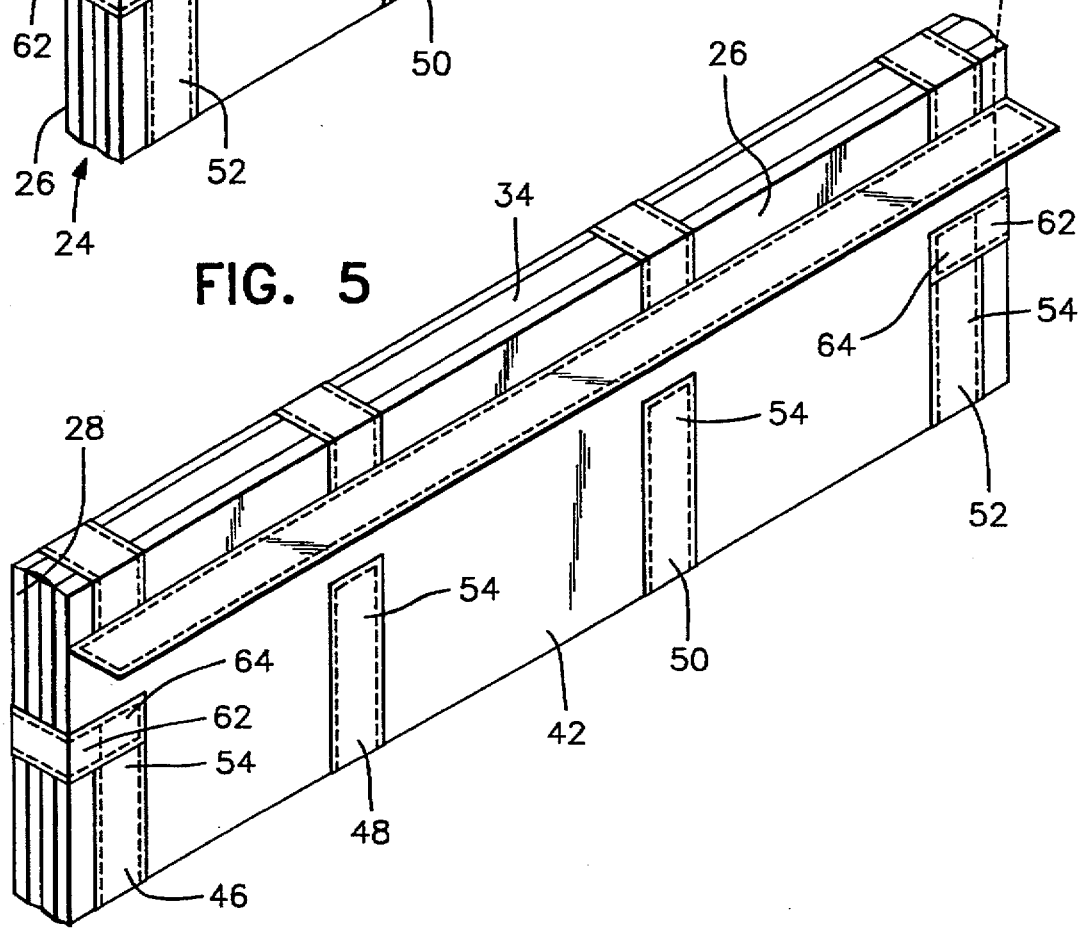
FIG. 5 is a schematic perspective view of the pad assembly of FIG. 4 showing the opposite or rear side thereof.

In order to retain the pad sections 26 and 28 in their raised position as illustrated in FIG. 3, at least two flat straps or retaining members preferably wrap around the pad sections 26 and 28 at longitudinally spaced positions on the pad assembly. In a preferred embodiment for pad assembly 24, which has a length of approximately 40 inches, four strap members 46, 48, 50 and 52 are employed at spaced locations along the length of the pad assembly 24. As shown, the straps 46, 48, 50, 52 are double thickness, preferably made of the same material as covering 29, which are suitably stitched and/or glued together. Each strap has one set of corresponding ends 54 attached by stitching or the like to the double thickness panel or sheet 42, see FIGS. 2, 3 and 5. The other set of ends 56 of straps 46, 48, 50, 52 underlie the pad sections 26 and 28 when they are in their fully deployed position on the floor, as illustrated in FIGS. 2 and 6. The double thickness sheet 42 has four hook pile fastener strips 58, see FIG. 2, secured thereto at points spaced longitudinally therealong corresponding to the spacing of the straps 46, 48, 50, 52, and the free ends 56 of the straps 46, 48, 50, 52 have loop pile fastener strips 60 secured to the outer surface of the strap ends.

Figure 4:
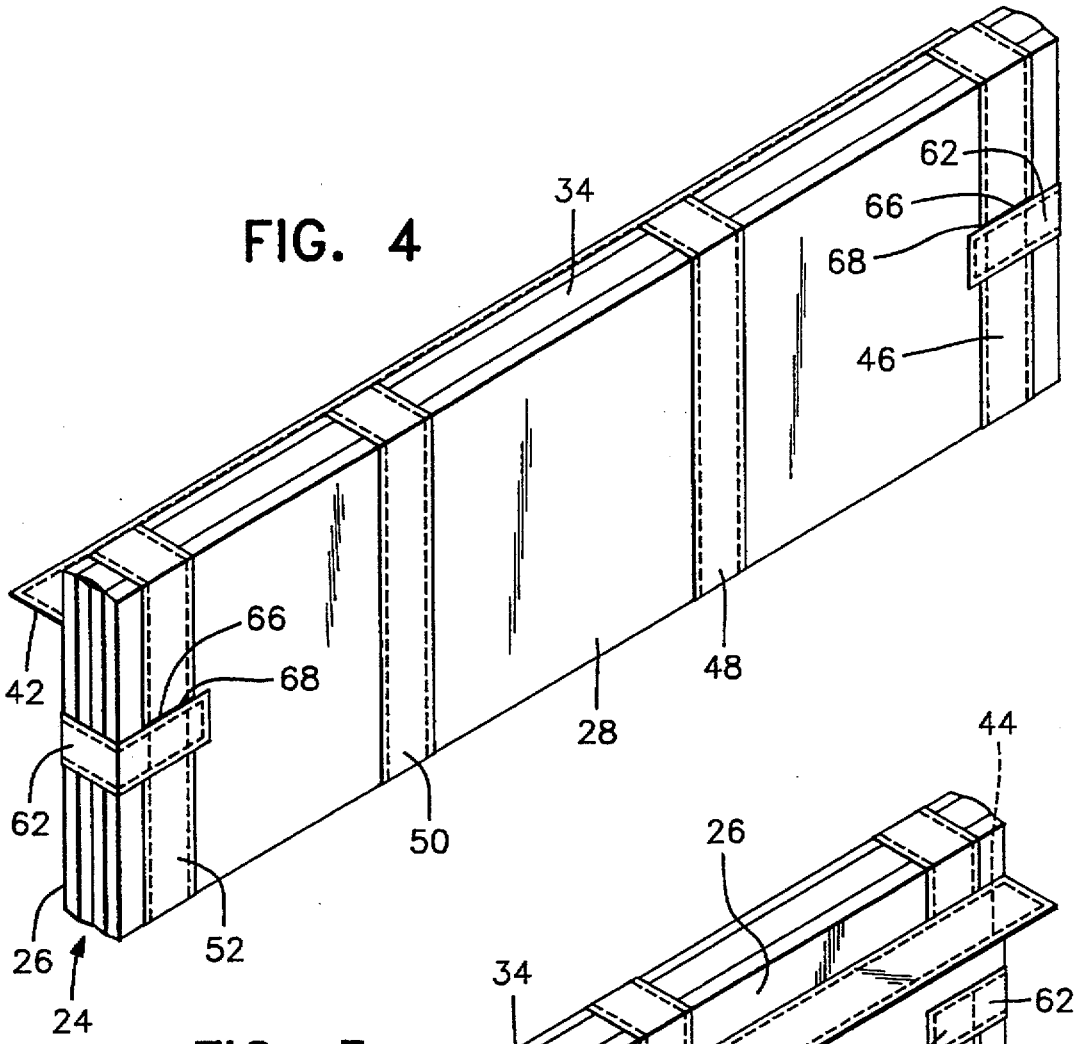
FIG. 4 is a schematic perspective view illustrating the bed foot end pad assembly of FIGS. 2 and 3 in a strap secured folded condition.

After the pad sections 26 and 28 are raised to the parallel vertical position illustrated in FIG. 3, the straps 46, 48, 50, 52 are pulled up tightly about the raised pad sections 26 and 28, over end margins 36 and 38, now at the top of the side-by-side pad sections 26 and 28 (see FIG. 3), and downwardly along the pad section 26 to a position between the pad section 26 and the hook pile fastener strips 58. The loop pile fastener strips 60 are then engaged with the hook pile fastener strips 58 to releasably anchor the strap end to the panel 42 and thus to the bed 10. Also, a pair of straps 62 having one set of ends 64 secured to the straps 46 and 52, see FIG. 5, preferably extend about the short edges of the folded pad sections 26 and 28 and include loop pile fastener strips 66 secured to their free ends. The loop pile fastener strips 66 are then releasably engaged with hook pile fastener strips 68 carried by the straps 46 and 52 at a location intermediate their length, see FIGS. 3 and 4. In this manner, the pad sections 26 and 28 are held tightly in their raised parallel vertical positions along the side of the bed 10 relative to the double thickness sheet 42, as shown in FIG. 3.

It will be noted that when the pad sections 26 and 28 are deployed as shown in solid lines in FIG. 6, the undersides thereof contact the floor 14. When the pad sections 26 and 28 are moved to their raised vertical position illustrated in FIG. 3, the side surfaces of sections 26 and 28 previously engaged with the floor now closely oppose each other. Hence, these surfaces are shielded and not exposed. Thus, in the preferred embodiment of the present invention, when the pad assembly is folded to its stored position, the floor contacting surfaces are not readily available for accidental contact by a patient on the bed 10, or otherwise.

As stated above, the bed head end pad assembly 25 is constructed similarly to assembly 24, although one or both of the straps 48 and 50 may be omitted, inasmuch as the pad assembly 25 is not as long as the pad assembly 24.

Figure 7:
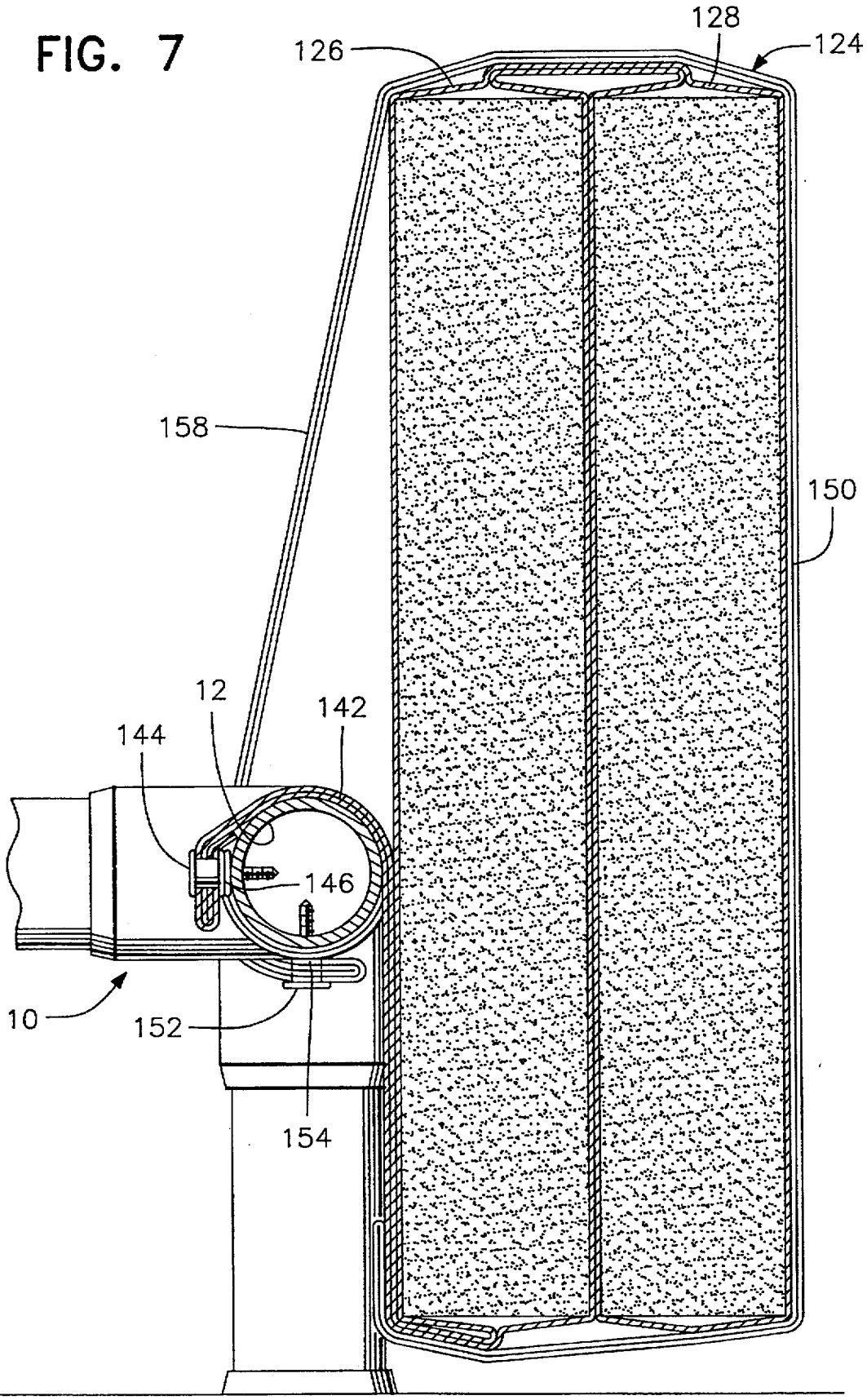
FIG. 7 is an enlarged fragmentary vertical sectional view similar to FIG. 3 but illustrating a modified form of raised and folded pad assembly operatively associated with a second form of low clearance bed, such as illustrated in FIG. 8.

With attention now invited more specifically to FIG. 7 of the drawings, there may be seen a second embodiment of the pad assembly of the present invention, generally referred to by the reference numeral 124. The pad assembly 124 is substantially identical to the pad assembly 24, except that the free marginal edge of the double thickness sheet or panel 142, corresponding to sheet or panel 42 of pad assembly 24, is removably secured to the side rail or tube 12 of the bed 10 through the utilization of releasably engageable fastener elements 144 carried by the double thickness sheet 142 and fastener elements 146 anchored relative to the rail 12. The fastener elements 144 and 146 are preferably of the snap fastener type whereby they may be releasably engaged with each other. In addition, the free ends of the straps 150, corresponding to the straps 46, 48, 50, 52 are also removably fastened to the side rail or tube 12 through the utilization of fastener elements 152 and 154. Because the free end portions 158 of the straps 150 are inclined as illustrated in FIG. 7 when the pad sections 126 and 128 corresponding to the pad sections 26 and 28 are in their raised, vertical parallel position, the straps 150 ensure that the pad sections 126 and 128 remain compactly folded and in the raised vertical position along the side rail or tube 12. This configurations can eliminate the need for straps corresponding to the straps 62.

Figure 8:
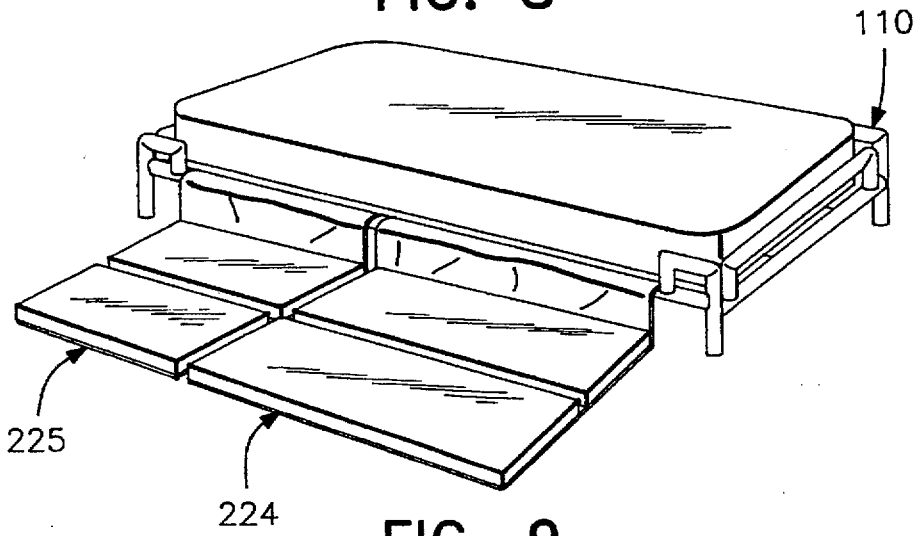
FIG. 8 is a perspective view of the second form of low clearance bed with which pad assemblies of the present invention are illustrated in the deployed position, with the bed head end pad being shorter than the bed foot end pad.

FIG. 8 of the drawings illustrates a modified form of low height bed 110 with which pad assemblies 224 and 225 are operatively associated. The pad assemblies 224 and 225 each may be constructed like pad assembly 24 or like pad assembly 124.

Figure 9:
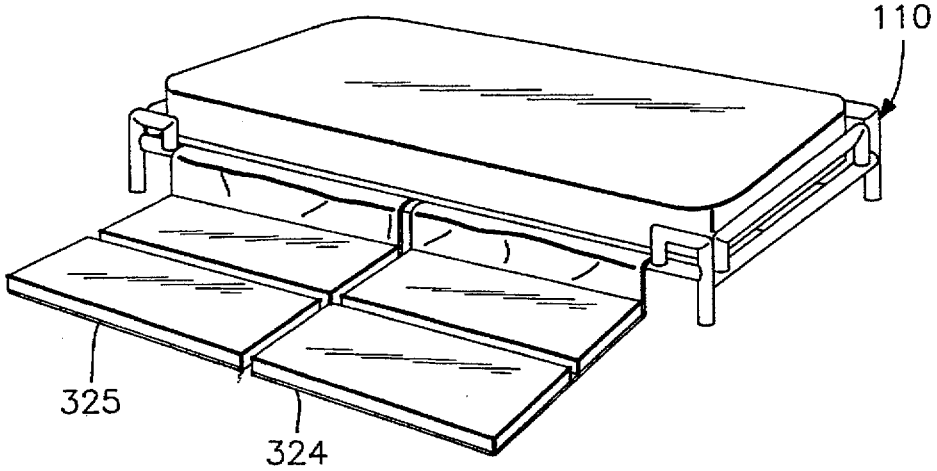
FIG. 9 is a perspective view similar to FIG. 8, but utilizing pad assemblies having approximately the same length.

FIG. 9 illustrates the bed 110 having a pair of pad assemblies 324 and 325 operatively associated therewith. The pad assemblies 324 and 325 also may be constructed either like pad assembly 24 or pad assembly 124. However, the pad assemblies 324 and 325 are each about 30 inches in length as opposed to being about 40 inches and about 20 inches in length, as described for pads 24, 224 and 25, 225, respectively. The beds 10 and 110 are usually six feet in length and the total length of the two pad assemblies associated with each bed is about 60 inches, plus the spacing between adjacent pad assemblies, if any.

As illustrated in the drawings and described herein, the various edges and seams of the components of the pad assembly of the present invention are preferably rolled, stitched and/or glued as is well known in the art relating to pad structures and assemblies. Any suitable stitching and assembly can be used consistent with the overall construction of the pad assemblies falling within the scope of the present invention. Also, while hook and loop pile fasteners and snap fasteners are preferred for mounting the pad assembly onto the bed frame or bed 10 any suitable fastening assembly can be used within the scope of the present invention, although releasable fastening assemblies are preferred so that the pad assembly can be removed from the bed 10 when desired. Further, other retaining structure besides straps 46, 48, 50, 52 and 150 can be utilized to retain the pad assembly, such as assemblies 24 and 25, in their raised, stored condition. Where hook and loop pile fasteners such as VELCRO® type hook and loop pile fasteners are used, the relative positions of the hook pile portion and the loop pile portion is considered interchangeable. In addition, other fasteners can be used in lieu of hook and loop pile fasteners, such as belt and buckle fasteners or any other suitable fastener for the retaining purposes required for the present invention.

Also, one pair of the pad assemblies will preferably be used on only one side of the associated bed if the other side of that bed is against a wall. However, if a bed has both sides appreciably spaced from opposing walls, both bed sides should have pad assemblies operatively associated therewith.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with a bed including opposite side longitudinal marginal portions and supported on a floor, a pad assembly for raised storage and lowered horizontal deployment from one of said side marginal portions, said pad assembly including an elongated pad structure which can be manipulated between a stored raised position extending along said one side marginal portion and a deployed horizontal position lying generally flat upon the floor outwardly from said bed adjacent said one marginal portion, releasable attaching structure for releasably attaching said pad structure to said bed which supports said pad structure in a raised stored position off said floor and allows said pad structure to lie generally flat upon the floor when deployed, and retaining means operative to releasably retain said pad structure in said raised position.

2. The combination of claim 1 wherein said bed includes a low height frame.

3. The combination of claim 1 wherein said floor pad structure includes first and second elongated pad sections each including opposite end margins and opposite first and second major area side surfaces, joining structure extending between and joining one pair of said end margins for relative angular displacement of said pad sections between deployed edge-to-edge generally horizontal coplanar position with said first major area side surfaces facing upwardly and folded raised generally parallel vertical position with said second major area side surfaces opposing each other.

4. The combination of claim 1 wherein said pad structure is flexible and bendable and formed with resilient padding encased in a flexible outer covering.

5. In combination with a bed on a floor and including opposite side longitudinal marginal portions, a pad assembly for deployment from one of said side marginal portions, said pad assembly including an elongated pad structure which can be manipulated between a stored position extending along said one marginal portion and a deployed horizontal position lying generally flat upon the floor outwardly from said bed adjacent said one side marginal portion, releasable attaching structure for releasably attaching said pad structure to said bed which supports said pad structure in a stored position and allows said pad structure to lie generally flat upon the floor when deployed, retaining means operative to releasably retain said pad structure in said stored position, said pad assembly including at least two pad assemblies laterally spaced apart along said one side marginal portion.

6. The combination of claim 5 wherein said pad assemblies are of equal length.

7. The combination of claim 5 wherein said pad assemblies are of unequal length.

8. In combination with a bed on a floor and including opposite side longitudinal marginal portions, a pad assembly for deployment from one of said marginal portions, said pad assembly including an elongated pad structure which can be manipulated between a stored position extending along said one side marginal portion and a deployed horizontal position lying generally flat upon the floor outwardly from said bed adjacent said one side marginal portion, releasable attaching structure for releasably attaching said pad structure to said bed which supports said pad structure in a stored position and allows said pad structure to lie generally flat upon the floor when deployed, and retaining means operative to releasably retain said pad structure in said raised position and including a plurality of straps spaced apart along said pad assembly which releasably tighten about said pad structure.

9. The combination of claim 8 wherein said straps include a first set of ends anchored relative to said pad structure and a second set of ends releasably anchored to said support structure.

10. The combination of claim 8 wherein said straps include a first set of ends secured to said pad structure and a second set of ends releasably secured to said one marginal portion.

11. In combination with a bed having opposite side longitudinal marginal portions, a pad assembly for deployment from one of said side longitudinal marginal portions, said pad assembly including an elongated pad structure which can be manipulated between a raised position extending along said one marginal portion and a deployed horizontal position lying generally flat upon a floor outwardly from said bed adjacent said one marginal portion, releasable attaching structure for releasably attaching said pad structure to said bed which supports said pad structure in a stored position and allows said pad structure to lie generally flat upon the floor when deployed, said support structure including a flexible panel extending from one end of said pad structure and releasably secured to said one bed longitudinal marginal portion, and retaining means operative to releasably retain said pad structure in said raised position.

12. The combination of claim 11 including snap fasteners removably securing said flexible panel to said one bed longitudinal marginal portion.

13. The combination of claim 11 including hook and loop pile fastener strips removably securing said flexible panel to said one bed marginal portion.

14. A floor pad assembly for raised storage and lowered open deployment from one side of a low height bed frame comprising inner and outer pad sections each including opposite side margins and opposite first and second major area side surfaces, connecting structure extending between and joining one pair of said side margins for relative angular displacement of said pad sections between a deployed side-by-side generally horizontal coplanar position resting on a floor with said first major area side surfaces facing upwardly and a folded raised storage position with said second major side surfaces opposing each other, support structure carried by a side margin of said inner pad section remote from said connecting structure for supporting said side margin from said one side of said bed frame, and retaining means operative to releasably retain said pad sections in said folded raised position and including a plurality of straps spaced apart longitudinally along said pad assembly and releasably tightened about said pad sections.

15. The floor pad assembly of claim 14 wherein said straps include a first set of ends anchored relative to said pad assembly and a second set of ends releasably anchored to said first set of ends.

16. A floor pad assembly for storage and open deployment from one side of a bed which comprises a pair of elongated generally rectangular pad sections each including opposite first and second sides of approximately the same size, connecting structure extending between and connecting said sections along side edges for relative angular displacement of said pad sections between a deployed edge-to-edge generally horizontal coplanar position resting on a floor with said first sides facing upwardly and a folded storage position with said second sides substantially in contact with each other, support structure carried on one of said pad sections for connecting said pad assembly to said one side of said bed, and retaining means operative to releasably retain said pad sections in said folded condition.

17. The floor pad assembly of claim 16 wherein said support structure comprises an integral flexible panel extending from an edge of said one pad section and releasably secured to said one side of said bed.

18. The floor pad assembly of claim 16 wherein said retaining means includes a plurality of straps spaced apart transversely of said pad sections which releasably tighten about said pad sections in said folded condition.

19. The floor pad assembly of claim 18 wherein said pad sections include an inner pad section and an outer pad section and said straps include a first set of ends anchored relative to said inner pad section and a second set of ends releasably anchored with respect to said bed.

20. The floor pad assembly of claim 16 wherein said support structure supports said pad sections in said folded storage position spaced above said floor.

21. The floor pad assembly of claim 16 wherein said pad sections are bendable and formed by resilient padding within a flexible outer covering and said covering carries said support structure.

* * * * *